United States Patent [19]
Page et al.
[11] 4,191,989
[45] Mar. 4, 1980

[54] RECESSED INTERIOR FLUORESCENT LUMINAIRE

[75] Inventors: Burford J. Page; Winfried N. Westermann, both of Vicksburg, Miss.

[73] Assignee: Westinghouse Electric Corp., Pittsburgh, Pa.

[21] Appl. No.: 876,394

[22] Filed: Feb. 9, 1978

[51] Int. Cl.² ..... F21S 3/00
[52] U.S. Cl. ..... 362/220; 362/225; 362/238; 362/260
[58] Field of Search ..... 362/217, 219, 220, 223, 362/225, 232, 238–240, 285, 260

[56] References Cited

U.S. PATENT DOCUMENTS

| | | | |
|---|---|---|---|
| 2,249,318 | 7/1941 | Locke | 362/220 |
| 2,399,531 | 4/1946 | Young | 362/217 X |
| 2,617,919 | 11/1952 | Hohl | 362/217 |
| 2,958,763 | 11/1960 | Bodian | 362/220 |
| 3,281,588 | 10/1966 | Spinetta . | |
| 3,469,089 | 9/1969 | Picha | 362/220 |
| 3,555,268 | 1/1971 | Zurawski | 362/220 |

*Primary Examiner*—Peter A. Nelson
*Attorney, Agent, or Firm*—B. R. Studebaker

[57] ABSTRACT

A recessed interior fluorescent luminaire construction including a reversible interior ballast housing which adapts the luminaire for either four lamp or three lamp construction with the lamps lying in a horizontal plane above and parallel with the luminaire refractor. This construction further provides for minimal luminaire height and therefor requires minimal plenum space.

5 Claims, 8 Drawing Figures

FIG. 8.
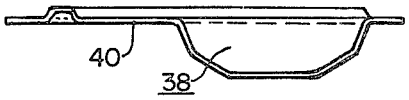
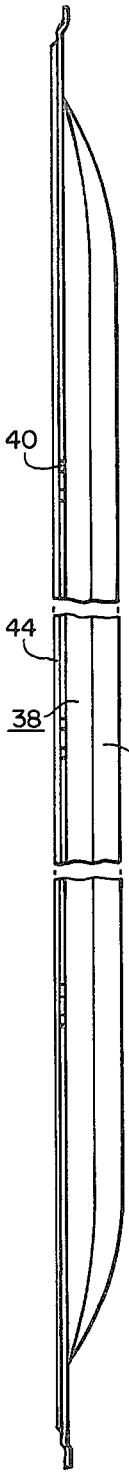
FIG. 6.
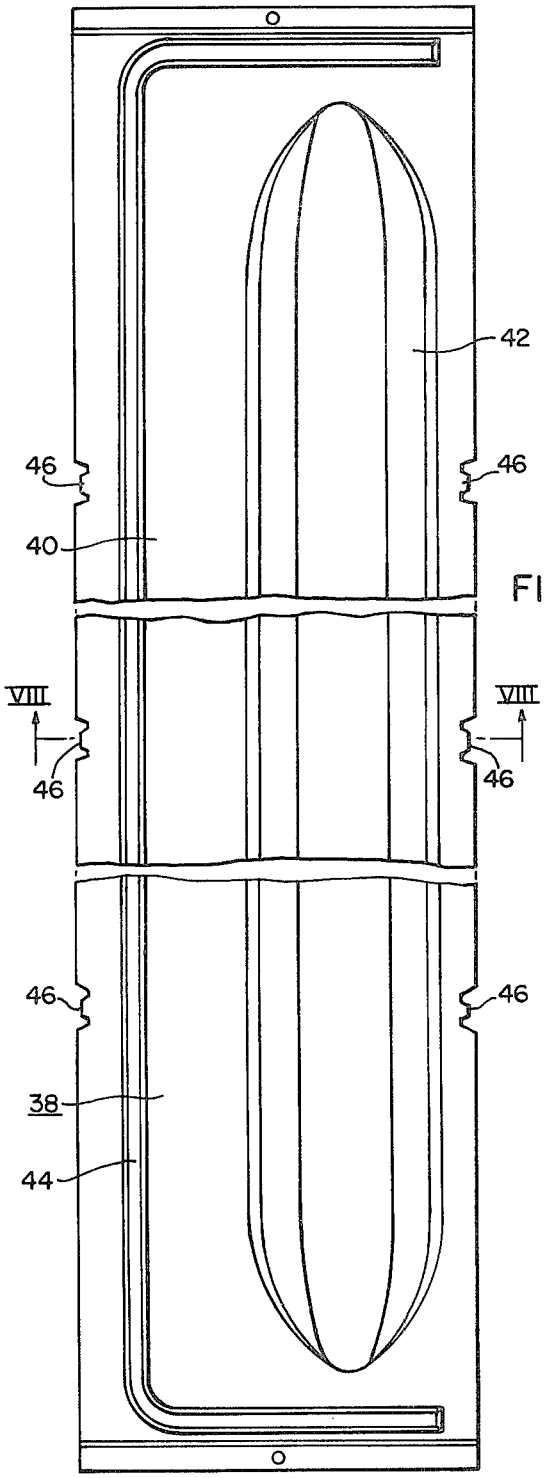
FIG. 7.

RECESSED INTERIOR FLUORESCENT LUMINAIRE

BACKGROUND OF THE INVENTION

In the design and manufacture of interior recessed fluorescent lighting fixtures it has always been desirable to maintain a low profile or silhouette for that fixture in order that the fixture might be accommodated within plenum spaces above the ceiling which vary significantly in their height or distance below the permanent ceiling. In order to achieve this, as small as possible, height dimension for the luminaire housing it has been a common practice to mount the wire-way and ballast housing to the undersurface of the top wall of the luminaire housing and thereby dispose the ballast housing and wire-way within the confines of the luminaire housing walls. In some constructions the ballast housing is made a permanent part of the luminaire top wall with access being provided from either one or both of the top and bottom of the ballast housing. In other constructions the ballast housing, in its entirety, may be removably secured to the underside of the top wall as illustrated in U.S. Pat. No. 3,281,588 to Spinetta.

As also illustrated in the above referenced Spinetta patent it is desirable that the fluorescent lamps mounted within the fixture be located the same distance above the luminaire refractor in order to provide both balanced light distribution and uniform appearance across the face of the refractor when viewed from the room lighted by the luminaire. For example, should one of the lamps be closer to the refractor than the remainder in the lamp array a distinct bright line will be in evidence as the refractor is viewed from below because of the proximity of the one lamp to the refractor surface.

Applications for recessed interior fluorescent luminaires differ considerably and it is at times desirable in the same fixture dimensions to provide a luminaire containing two, three or four elngated fluorescent lamps. It is also desirable that the number of lamps employed in the fixture be uniformly spaced within the luminaire housing to provide both uniform light distribution and symmetrical refractor appearance. In prior aret installations, when a single fixture design was utilized for both three and four lamp installations, the ballast housing was generally provided along the center line of the longitudinal dimension of the luminaire. This construction was no problem for four lamp fixtures but when three lamp installations were required the center lamp would have to be located below the ballast housing thereby bringing its location closer to the luminaire refractor and providing, when lighted, a non uniform appearance across the refractor face.

SUMMARY OF THE INVENTION

A low profile recessed interior fluorescent luminaire which is adapted for either four lamp or three lamp accommodation is provided in accordance with the present invention, by employing a reversible ballast housing cover removably mounted to the underside of the top wall of the luminaire, which ballast housing, in a first position is situated along the longitudinal center line of the luminaire housing and in a second position is offset from the longitudinal center line of the luminaire housing to provide a position for the center lamp of a three lamp array.

The foregoing is accomplished in accordance with the present invention by providing an interior fluorescent luminaire of either the four or three lamp type which comprises a housing including a top wall, a pair of end walls and a pair of side walls defining a bottom opening and a refractor closing off the bottom opening for distributing light emanating from a plurality of lamps mounted in oppositely disposed lamp holders secured to each of the end walls of the housing. A reversible ballast cover is mounted to the underside of the top wall and is constructed and arranged to be removably secured thereto in either a first position centrally of the luminaire housing to accommodate four lamp construction or laterally offset from the center line of the luminaire to provide for three lamp construction. The top wall of the housing includes a plurality of depending lances into which a plurality of complemintary tabs on the ballast housing cover are seatable into to thereby secure the removable ballast cover to the top wall. The reversible ballast cover is generally planar except for an elongated trough shaped portion which depends therefrom and extends for substantially the length of the reversible ballast cover.

BRIEF DESCRIPTION OF THE DRAWING

Many of the attendant advantages of the present invention will become more readily apparent and better understood as the following detailed description is considered in connection with the accompanying drawing in which:

FIG. 6 is a side elevational view of the ballast housing cover of this invention;

FIG. 7 is a bottom plan view of the ballast housing cover; and

FIG. 8 is a sectional view of the ballast housing cover taken along the line VIII—VIII of FIG. 7.

DESCRIPTION OF THE PREFERRED EMBODIMENTS

Figure 1:
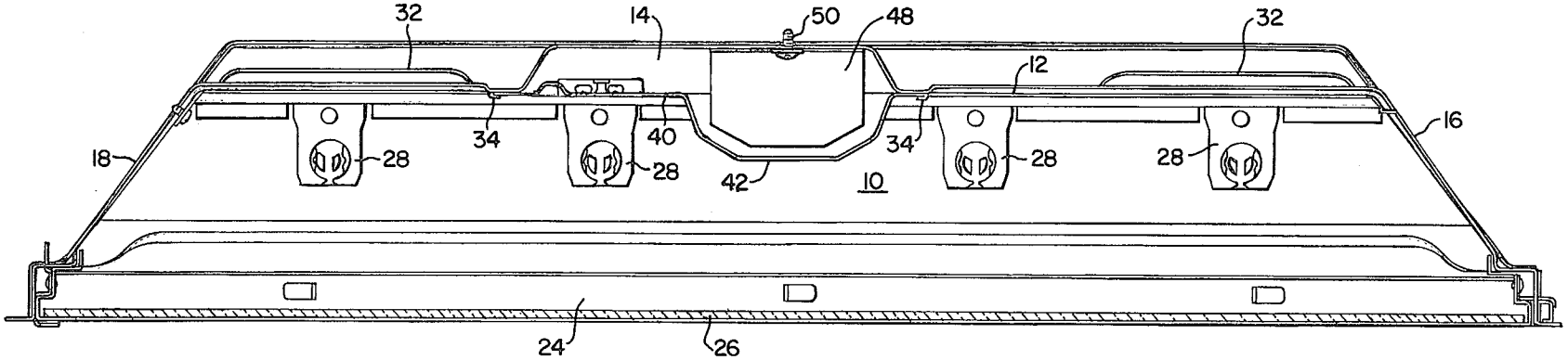
FIG. 1 is a lateral sectional view of a luminaire employing four lamps.
Figure 2:
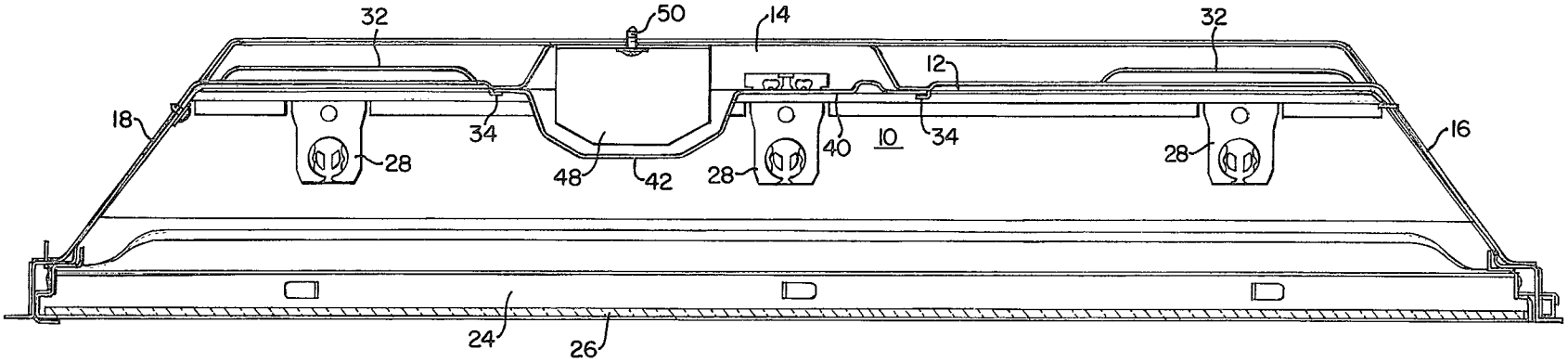
FIG. 2 is a lateral sectional view of the same luminaire in a three lamp configuration.
Figure 5:
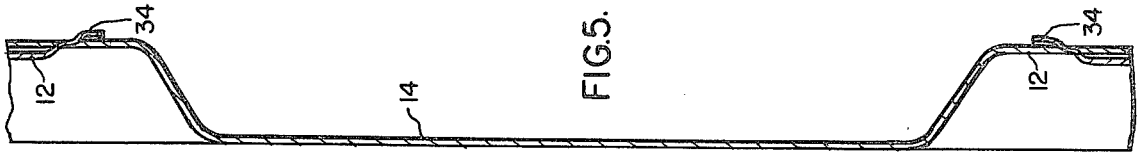
FIG. 5 is a sectional view taken along the line V—V of FIG. 4.
Figure 4:
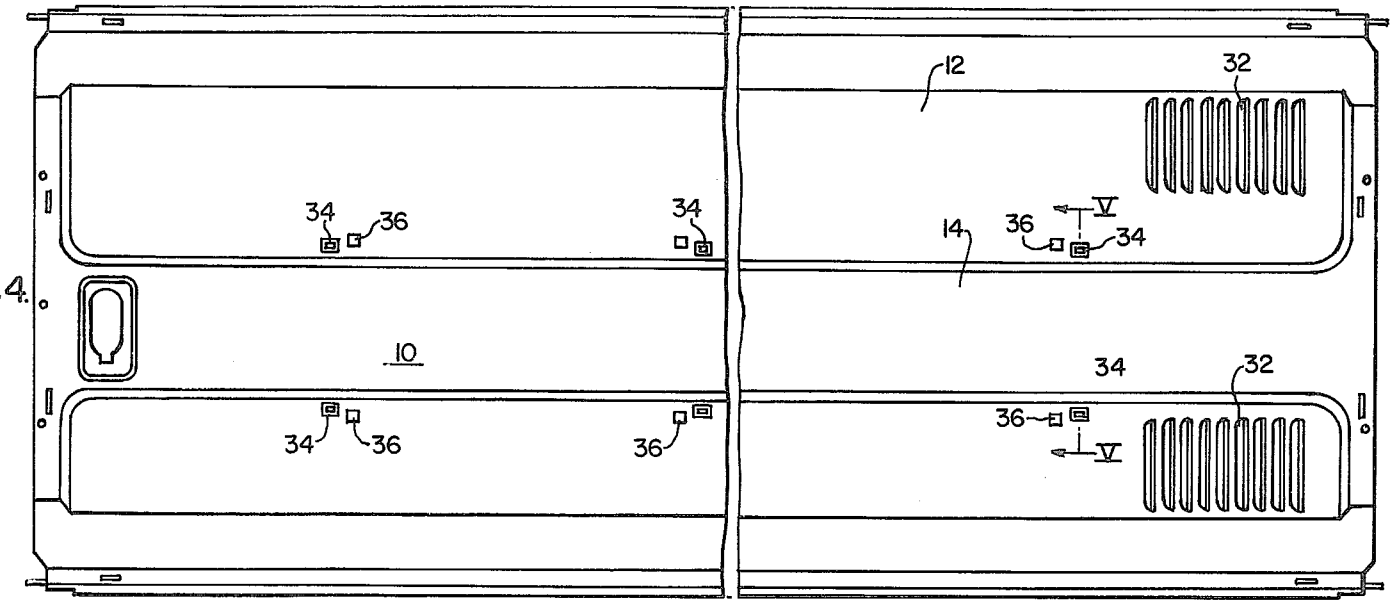
FIG. 4 is a partial top plan view of the luminaire of this invention.
Figure 3:
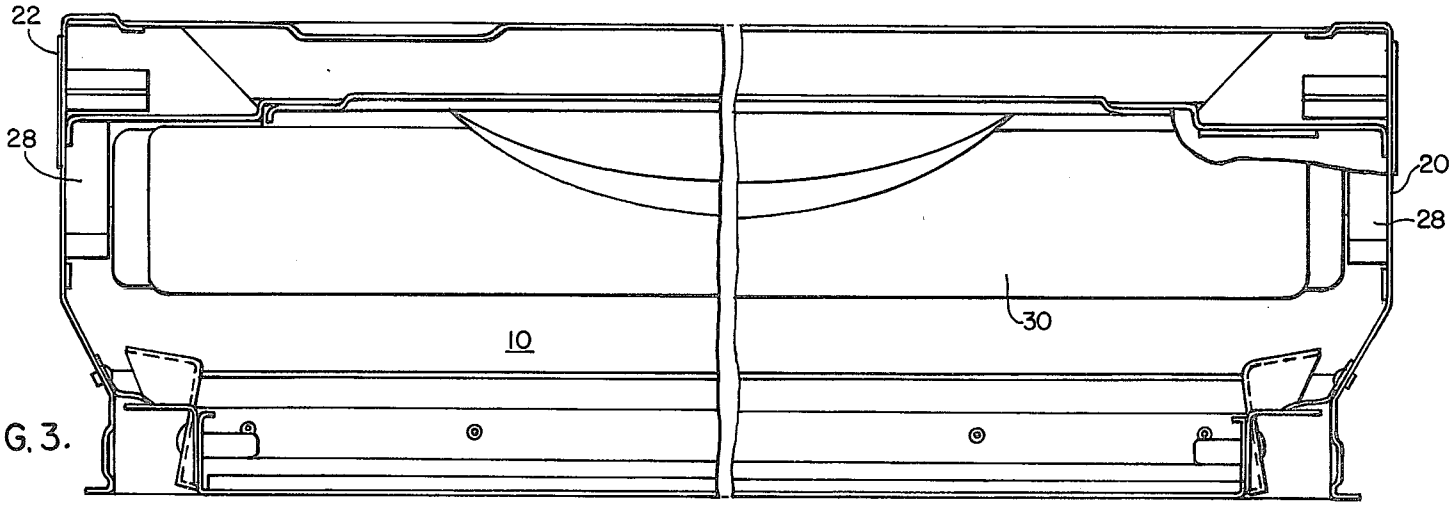
FIG. 3 is a partial longitudinal sectional view of the luminaire of FIGS. 1 and 2.

Referring now in detail to the drawing, wherein like reference characters represent like parts throughout the several views, there is illustrated in FIGS. 1 and 2, the alternative construction for a recessed interior fluorescent luminaire having either three lamps or four lamps therein which is made possible by the reversible interior ballast housing cover of this invention. The luminaire generally designated 10 includes a top wall 12 with a raised central portion 14, side walls 16 and 18 and a pair of end walls 20 and 22. The raised central portion 14 of the top wall is designed, in conjunction with the ballast housing cover of this invention to define the ballast housing as will be later described.

The top wall and interconnected side and end walls define the open bottomed lamp cavity of the luminaire, which open bottom is closed off conventionally by a light transmitting refractor carrying door frame 24 which has mounted therein a refractor 26.

A plurality of lamp holders 28 are mounted to each of the end walls 20, 22 and are adapted to receive fluorescent lamps 30 therein in a conventional manner. The top wall 12 may additionally include a plurality of louvers 32 to facilitate utilizing the luminaire as an air handling lighting fixture.

In order to permit the single luminaire housing to be quickly converted to a three lamp or four lamp fixture and still retain the lamps in a planar array equidistantly spaced above the refractor 26, the top wall 12 is provided with a plurality of lances 34 and adjacent apertures 36 which facilitate the removable mounting of the internal ballast housing cover generally designated 38, which includes a planar plate portion 40 and an elongated dependent trough portion 42 which extends for substantially the length of the plate 40 offset from the longitudinal center line thereof. The plate 40 also carries an elongated U-shaped strengthening rib 44 raised therefrom in a direction opposite the elongated trough shape portion 42. The side edges of the ballast housing cover plate 40 include a plurality of complimentary tabs 46 which are seatable in the lances 34 in the top wall 12.

As will be apparent, and as best visualized in FIGS. 1 and 2, the ballast housing cover 38 is secured in a first position as illustrated in the FIG. 1 embodiment to accommodate a four lamp fixture and may be reversed as illustrated in the FIG. 2 embodiment to adapt the luminaire for three lamp construction. Mounting of the ballast housing cover to the top wall 12 of the luminaire in the area of the raised ballast housing portion 14 is accomplished through the interconnection of the tabs 46 with the lances 34 and the ballast housing cover can be readily removed by applying pressure to the side edge of the ballast housing cover through the apertures 36 with a screwdriver or a similar implement. A conventional fluorescent ballast 48 may be mounted within the cavity defined by the raised portion of the top wall 14 and the internally disposed trough portion 42 of the ballast housing cover by means of screws 50 or similarly and may readily be positioned centrally along the longitudinal center line of the luminaire housing as illustrated in FIG. 1 for a four lamp fluorescent lighting fixture or may be offset from the longitudinal center line of the luminaire housing as illustrated in FIG. 2 to accommodate a three lamp fluorescent lighting fixture construction.

As will be readily apparent from the foregoing, a luminaire construction has been provided which accommodates either four lamp or a three lamp construction for a fluorescent luminaire which also permits those lamps to lie within the luminaire cavity in planar array all equidistantly spaced above the light transmitting refractor of the luminaire door while requiring no additional or unique parts to provide for such modification. The reversible ballast housing cover disposed within the luminaire cavity may be positioned along the longitudinal center-line of the luminaire housing thereby permitting four lamp construction for the luminaire without interferring with the lamp spacing and by reversing that same ballast housing cover the luminaire can be converted to a three lamp fluorescent fixture still permitting equidistnat spacing of the lamps in the luminaire cavity while retaining the consistent spacing of those lamps in either mode of construction the same distance above the luminaire refractor thus eliminating any bright spot or line resulting from one or more of the lamps being closer to the luminaire refractor than the remainder of the lamps in the array, and also providing for uniform light distribution.

What is claimed is:

1. An interior fluorescent luminaire of either the four lamp or three lamp type comprising:
   - a luminaire housing including;
   - a top wall, a pair of end walls and a pair of side walls defining a bottom opening;
   - a refractor closing off said bottom opening for distributing light emanating from said luminaire;
   - a plurality of oppositely disposed lamp holders mounted to each of said end walls; and
   - a reversible ballast housing cover mounted to the underside of said top wall constructed and arranged to be removably secured thereto in either a first or second position to thereby accommodate either three or four equidistantly spaced fluorescent lamps in a planar array.

2. The interior fluorescent luminaire according to claim 1 wherein said top wall includes a plurality of dependent lances and said reversible ballast housing cover includes a plurality of complimentary tabs seatable in said lances to thereby secure said reversible ballast housing cover to said top wall in either of said first or second positions.

3. The interior fluorescent luminaire according to claim 2 wherein said reversible ballast housing cover is generally planar except for an elongated trough shaped portion which depends therefrom and extends for substantially the length of said reversible ballast housing cover, said elongated trough shaped portion being laterally disposed from the longitudinal center line of said reversible ballast housing cover.

4. An interior fluorescent luminaire of either the four lamp or three lamp type comprising:
   - a luminaire housing including;
   - a top wall, a pair of end walls and a pair of side walls defining a bottom opening;
   - a door, including a refractor closing off said bottom opening for distributing light emanating from said luminaire;
   - a plurality of oppositely disposed lamp holders mounted to each of said end walls; and
   - a reversible ballast housing cover mounted to the underside of said top wall, said reversible ballast housing cover including an elongated trough shaped portion offset from the longitudinal center line of said reversible ballast housing cover constructed and arranged to be mounted to said top wall along the longitudinal center line of said luminaire housing in a first position and reversible to be mounted offset from said longitudinal center line of said luminaire housing in a second position.

5. The interior fluorescent luminaire according to claim 4 wherein said top wall includes a plurality of depending lances and said reversible ballast housing cover includes a plurality of complimentary tabs seatable in said lances to thereby secure said reversible ballast housing cover to said top wall in either of said first or second positions.

* * * * *